US005975064A

United States Patent [19]

Krimmer et al.

[11] Patent Number: 5,975,064

[45] Date of Patent: Nov. 2, 1999

[54] EXHAUST GAS RECIRCULATION VALVE FOR AN INTERNAL COMBUSTION ENGINE

[75] Inventors: Erwin Krimmer, Pluederhausen; Bruno Hezel; Eberhard Wizgall, both of Stuttgart; Tilman Miehle, Kernen; Peter Jauernig, Tiefenbronn, all of Germany

[73] Assignee: Robert Bosch GmbH, Stuttgart, Germany

[21] Appl. No.: 08/945,747

[22] PCT Filed: Sep. 19, 1996

[86] PCT No.: PCT/DE96/01775

§ 371 Date: Aug. 14, 1998

§ 102(e) Date: Aug. 14, 1998

[87] PCT Pub. No.: WO97/32125

PCT Pub. Date: Sep. 4, 1997

[30] Foreign Application Priority Data

Mar. 1, 1996 [DE] Germany ..... 196 07 811

[51] Int. Cl.[6] ..... F02M 25/07

[52] U.S. Cl. ..... 123/568.18; 251/129.07; 251/129.15

[58] Field of Search ..... 123/568.17, 568.26, 123/568.18, 568.21; 251/129.07, 129.15, 129.16

[56] References Cited

U.S. PATENT DOCUMENTS 4,921,208 5/1990 LaMarca ..... 251/30.04
5,065,979 11/1991 Detweiler et al. ..... 251/129.16
5,188,073 2/1993 Ejiri et al. ..... 123/339
5,701,874 12/1997 Sari et al. ..... 123/568.26
5,785,034 7/1998 Moedinger et al. ..... 123/568.18

*Primary Examiner*—Terry M. Argenbright
*Assistant Examiner*—Arnold Castro
*Attorney, Agent, or Firm*—Edward E. Griegg; Ronald E. Greigg

[57] ABSTRACT

An exhaust gas recirculation valve having a valve member that cooperates with a valve seat of a connection neck of an exhaust gas recirculation line. The neck protrudes into a tube of the intake system of an internal combustion engine, and the valve seat points toward the inlet side of the exhaust gas recirculation line. A valve member of the exhaust gas recirculation valve is thus acted upon by the exhaust gas pressure in the closing direction, as a supplement to a compression spring counter to an armature of an electromagnet acting in the opening direction. To compensate for the forces acting in the closing direction, the exhaust gas is carried via a conduit in the valve shaft into a control chamber, which is closed off from the pressure in the tube via a movable wall, having an effective surface area that substantially corresponds to the effective surface area of the valve member. This obtains a balance of forces, such that the control of the exhaust gas recirculation valve depends only on the electromagnetic forces and on the force of the compression spring.

20 Claims, 2 Drawing Sheets

EXHAUST GAS RECIRCULATION VALVE FOR AN INTERNAL COMBUSTION ENGINE

PRIOR ART

The invention is based on an exhaust gas recirculation valve. In one such exhaust gas recirculation valve, known from German Patent Disclosure DE-A 43 38 194, the valve seat is embodied as a conical seat that points into the interior of the exhaust gas recirculation line. A conical valve member comes into contact with this seat and is put in the closing position by the force of the spring and lifted from the valve seat by the electromagnetic force of the electromagnet. Such a valve has the disadvantage of being urged in the closing direction by the exhaust gas pressure in the closing position, so that considerable forces are required, in particular additionally when there is negative pressure in the tube, to put the valve in the opening position. This necessitates a large-sized electromagnet and high energy, which must be furnished at high cost by suitably embodied end stages.

ADVANTAGES OF THE INVENTION

The exhaust gas recirculation valve has the advantage over the prior art that by furnishing the movable wall, an equalization of the exhaust gas pressures acting on the valve member can be attained at the valve member. Accordingly, the actuation forces that the valve must exert in the opening position are only slight, thus allowing fast, exact switching of the exhaust gas recirculation valve. Moreover, the electromagnet can be small in size and can be operated with only a small input of energy. The expense for an electric trigger stage for the winding of the electromagnet is correspondingly small as well. In an especially advantageous way, the exhaust gas recirculation valve can be held in intermediate positions by means of analog or quasi-analog triggering that is clocked with a variable duty cycle.

In an advantageous further feature, the communication of the control chamber is effected via a conduit passing through the valve shaft, so that an immediate communication is realized without a separate line laid between the exhaust gas recirculation line and the control chamber. The result is a particularly small structure that is easy to assemble with few opportunities for mistakes. For pressure equalization, particularly in accordance with claim 3, the surface area of the valve member acted upon in the closing direction by the exhaust gas pressure is substantially equal in size to the surface area of the movable wall that acts in the opening direction of the valve member. By way of the dimensioning of this surface area, the closing force with the electromagnet not excited and the opening force of the electromagnet can be adjusted exactly. In a further advantageous feature, the movable wall comprises a diaphragm. The embodiment of the exhaust gas recirculation valve has the advantage that in the event of a crack in the diaphragm, the compensation for the exhaust gas pressure in the closing direction is dispensed with, and the valve can be kept securely closed by the exhaust gas pressure upstream of the valve member. A partial stream of exhaust gas then passes via the control chamber, the torn diaphragm, and the pressure chamber into the tube in the form of a partial quantity of an exhaust gas recirculation, which can be defined by the cross section of the conduit. In particular, if the diaphragm fails, hot exhaust gas is prevented from flowing out into the surroundings of the exhaust gas recirculation valve and reaching the engine compartment of the associated motor vehicle, where it could cause damage.

In another advantageous feature, the movable wall is embodied as a piston, so that failure of the kind that can be possible if a diaphragm is used is reliably avoided. With this embodiment, above all, the surface areas that act upon the valve member in compensation for the exhaust gas pressure in the closing direction of the valve can be determined very accurately. In an advantageous further feature a shielding cap is provided on the valve member, ahead of the mouth of the conduit; it assures that the pressure in the control chamber is not varied as a function of a dynamic head pressure but rather is established as a static exhaust gas pressure. The wall placed ahead diverts an incoming flow of exhaust gas to the mouth, so that exhaust gas can enter the conduit only crosswise to the mouth, at a pressure equivalent to the static pressure in the exhaust gas recirculation line. Thus a set discharge rate of the exhaust gas recirculation valve, especially if the exhaust gas recirculation valve is intended to assume intermediate positions between open and closed, is advantageously unaffected by the flow pressure. The way in which the neck enters into the tube has the advantage that the neck itself is intensively flushed by cooling air if there is a stream of air in the tube, and the introduction of exhaust gas takes place in the region of the flow profile in the tube that has the highest velocity, thus enabling very rapid, uniform turbulent mixing of exhaust gas with supplied air. If the mouth moves immediately adjacent to a throttle valve that controls the flow cross section of the tube, then this cooling and turbulent mixing effect is intensified at various positions of the throttle valve.

BRIEF DESCRIPTION OF THE DRAWINGS

Two exemplary embodiments of the invention are shown in the drawings and described in further detail below.

DETAILED DESCRIPTION OF THE INVENTION

Figure 1:
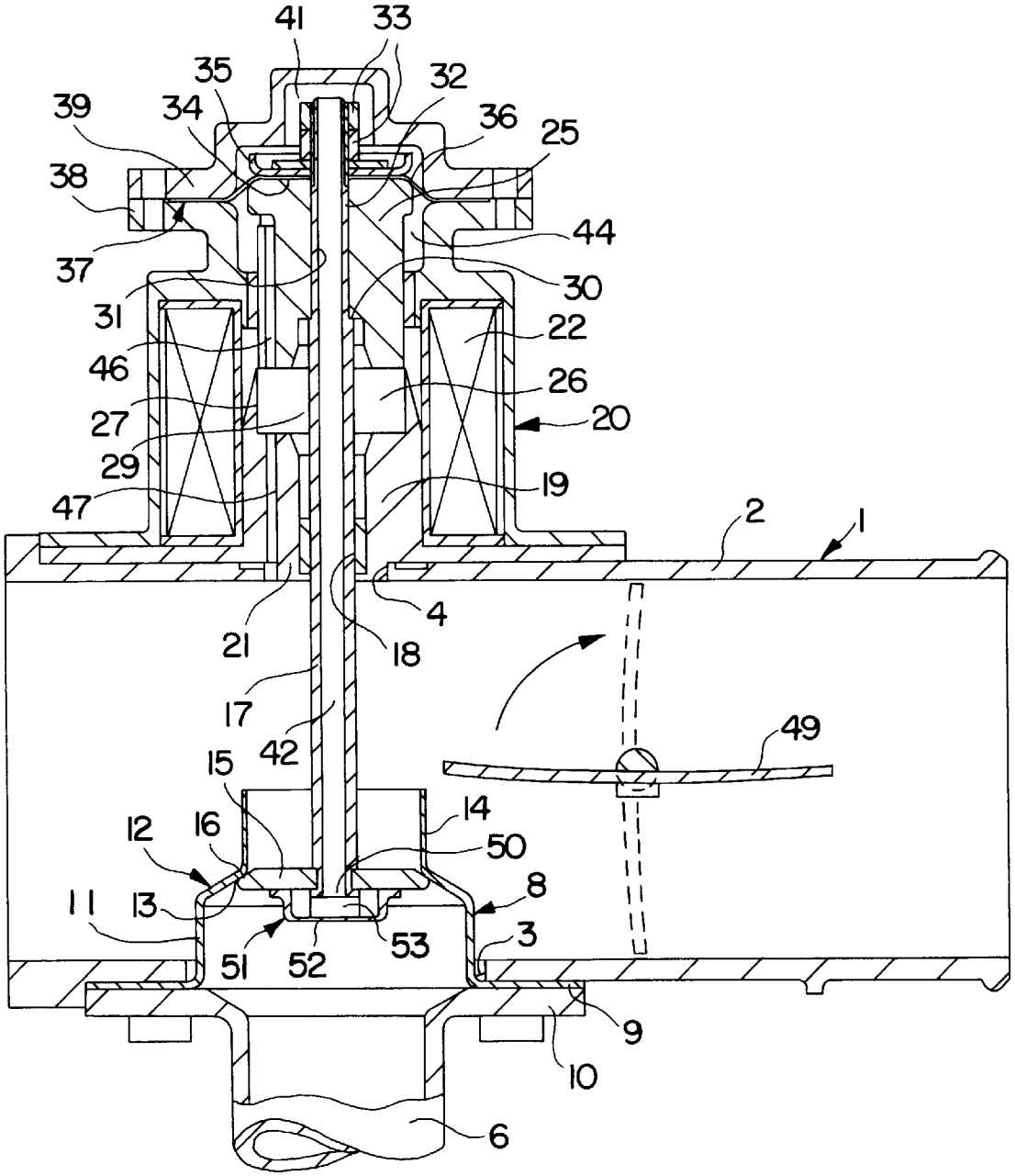
FIG. 1 shows a first embodiment of the exhaust gas recirculation valve, with a diaphragm as the movable wall.

In FIG. 1, a tube 1 is shown, which for example is part of an intake system of an internal combustion engine. Provided in the wall 2 of the tube 1 are a first opening 3 and, diametrically opposite it, a second opening 4. Via the first opening 3, an exhaust gas recirculation line 6 discharges into the tube 1. As a connection for the exhaust gas recirculation line, a connection neck 8 is provided, which protrudes into the interior of the tube through the opening 3. The neck 8 may for example be shaped as a deep-drawn sheet-metal part and has a flange 9 on its outside that is screwed together with a flange 10 of the exhaust gas recirculation line and a corresponding flange, not further shown, of the tube 1, so that the transition from the exhaust gas recirculation line and the neck is tightly closed. The neck is extended with lateral clearance through the opening 3 in order to establish thermal insulation, especially if the tube 1 is made from plastic.

Adjoining the cylindrical portion 11 of the neck that protrudes through the opening 3 is a conical portion 12, which forms a valve seat 13 whose seat face is oriented into the interior of the neck or toward the exhaust gas recirculation line. Adjoining the valve seat 13, the neck changes over into a tubular part 14 of reduced diameter, which has its mouth into the tube 1 shortly before the axis of the tube 1.

Cooperating with the valve seat 13 is a valve member 15, which has a conical sealing face 16 and is secured to one end of a valve shaft 17. This valve shaft is tightly guided in a bore 18 made axially into the core 19 of an electromagnet 20. The core 19 is guided by a connection neck 21 in the second opening 4 and is also tightly joined to the tube 1, in a manner further shown. The core has a magnet winding 22, which is disposed inside the housing 24 that receives the electromagnet. Cooperating with the core is a solenoid plunger or armature 25 of substantially circular-cylindrical form, which upon excitation of the magnet winding plunges into an axial recess 26 of the core 19. The annular wall 27 of the core surrounding the recess 26 increases in cross section with an increasing plunging depth. In this way, a linear characteristic of the electromagnet is attained. Acting counter to the magnetic force that attracts the armature into the recess 26 is a compression spring 29, which is fastened between the armature 25 and the magnet core 19 and is guided on the valve shaft 17.

As already noted above, the valve shaft 17 passes coaxially through the magnet core 19 and has the armature 25 on its end. In this exemplary embodiment, the valve shaft to that end has an outer annular shoulder 30, which points away from the tube 1, and the magnet has a core 31, by means of which the core is slipped over the reduced-diameter portion 32 of the valve shaft until it meets the shoulder 30. In this position, the core is fixed on the valve shaft 17 by lock nuts 33. Alternatively, the armature may be press-fitted onto the valve shaft. A disk 35 is embodied between the face end 34 and the lock nuts 33, and fastened between the disk and the face end 34 is a diaphragm 36, which is tightly enclosed on its outer circumference 37 between a flange 38 of the housing 24 and a cap 39.

Toward the cap 39, the diaphragm 36 encloses a control chamber 41, into which only one conduit 42 discharges, the conduit being passed coaxially through the valve shaft and discharging on its other end unclosably in the interior of the neck 8, upstream of the valve seat 13. On the side opposite the control chamber 41, the diaphragm defines a pressure chamber 44, which communicates unclosably with the interior of the tube 1 via a first conduit 46 in the armature 25 and a second conduit 47 in the core 19. A throttle valve 49 is also disposed on the neck 8, immediately adjacent the tube 1, in such a way that it can be moved from the fully open position, shown, into a fully closed position of the tube.

The free effective diameter of the diaphragm 36, which is acted upon on one side by the pressure in the control chamber 41 and on the other.by the pressure in the pressure chamber 44, is essentially equal in size to the diameter of the valve member 14 acted upon effectively in the closing direction of the valve member 15 by the pressure in the exhaust gas recirculation line. Thus the exhaust gas pressure acts in the opening direction on the valve member essentially on a surface area the same size as the surface area acted upon by the exhaust gas pressure in the closing direction. The exhaust gas forces on the valve member compensate for one another. The degree of compensation can be varied by the selection of the surface areas acted upon. It is then primarily the closing force of the compression spring 29 that acts in the closing direction of the valve member. Counter to the force of this spring, the exhaust gas recirculation valve is put in various opening positions upon excitation of the magnet winding 22 of the electromagnet 20. The force required to so do depends on the requisite closing force of the exhaust gas recirculation valve. However, it is unaffected by the pressures in the exhaust gas recirculation line and in the tube 1. This is because these negative pressures act both upon the face of the valve member 15 pointing toward the tube and the side of the diaphragm toward the pressure chamber 44. The resultant forces exerted on these faces cancel one another out. Such a valve is very small in size, because the relatively slight adjusting forces require only a small electromagnet.

Furnishing energy for such a magnet is not expensive, both with regard to energy generation and to the requisite triggering end stages of an electronic control unit. Advantageously, the magnet is triggered in clocked fashion with a variable duty cycle, so that various intermediate positions and hence metering cross sections of the exhaust gas recirculation valve can be established between "fully open" and "fully closed". Naturally the exhaust gas recirculation valve could also be triggered in analog fashion. In order particularly in the half-open and open positions to avoid an elevation of pressure in the control chamber 41, which could arise from a dynamic oncoming flow of the exhaust gas emerging from the exhaust gas recirculation valve, the mouth 50 of the conduit 42, which is located centrally relative to the valve member 15, is protected by a shielding cap 51. This shielding cap has a wall placed axially ahead of the mount and acting as an impact wall for the oncoming flow of exhaust gas. The exhaust gas can then enter the control chamber 41, for developing pressure, through lateral openings 53. This is done from a calm-flow zone inside the cap 51, with a pressure that is equal to the static pressure of the exhaust gas in the exhaust gas recirculation line.

The way in which the exhaust gas pressure is introduced into the control chamber 41 is especially advantageous because of the conduit 42 provided here in the valve shaft 17. Because of this embodiment, separate line connections between the exhaust gas recirculation line and the control chamber 41 are not needed; such lines would otherwise entail additional connection expense and sealing expense along with the possibility of damage. Naturally it is also possible, instead of the conduit that passes through the valve shaft, to provide some other suitable kind of communication, for instance in the form of a conduit that passes through the housing of the exhaust gas recirculation valve and the tube to the exhaust gas recirculation line, or a separate line leading that way.

Since there is no flow of exhaust gas through the control chamber 41, the gas contained there can give up its heat to the housing and remains far below the temperature of the exhaust gas that flows in via the exhaust gas recirculation line. Only the exhaust gas pressure is passed onward, but there is no substantial gas exchange by way of which the diaphragm would experience severe temperature stress. The exhaust gas entering the tube 1 when the exhaust gas recirculation valve is open is not released via the tubular part 14 until approximately the middle of the tube 1, at the place where the highest velocity components of a flow profile of the medium flowing through the tube 1 occur. In the present case, this medium is air or an airfuel mixture. The fact that it extends far into the tube 1 and that the connection neck is embodied with thin walls leads to intensive cooling of the neck by the cooler air bathing it, which draws heat from the point where the neck is connected to the tube 1; this heat is absorbed by the exhaust gas via the exhaust gas recirculation line 6 and carried further. Hence there is less thermal strain on the connecting point between the neck 8 and the tube 1. The immediate vicinity of the throttle valve intensifies the air flow. Introducing the exhaust gas into the heart of the flow in the tube 1 improves the rapid creation of turbulence and mixing of the introduced exhaust gas with the medium flowing there.

The valve construction described is damage proof to a high degree, in such a way that should the diaphragm 36 break, the compensation of forces by the exhaust gas pressure in the control chamber 41 is dispensed with; as a result, the exhaust gas pressure acts to an increased extent upon the valve member 15 in its closing direction. Thus an excessively high recirculation of exhaust gas cannot be established in any case, and this keeps an associated engine operational. Even if the magnet, in response to excessive exhaust gas pressure forces, should not longer be capable of functioning properly or of even opening the valve, some recirculation of exhaust gas still takes place to a slight extent via the conduit 42, the control chamber 41, and the conduits 46 and 47 into the tube 1. In no case, however, does exhaust gas enter the environment in the event that the diaphragm should break.

Figure 2:
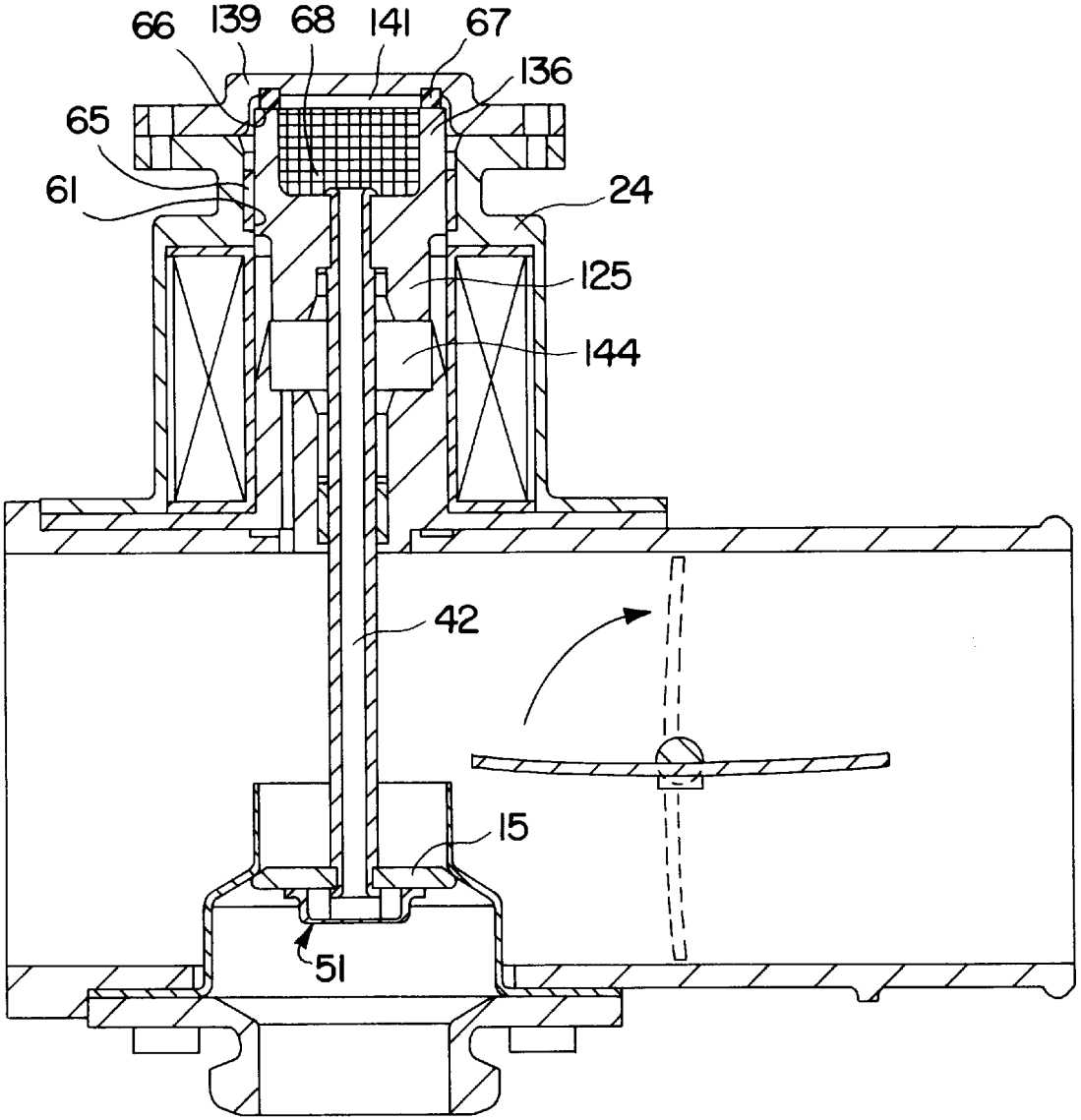
FIG. 2 shows a second embodiment of the exhaust gas recirculation valve, with a piston as the movable wall.

In a second embodiment of the exhaust gas recirculation valve according to the invention, shown in FIG. 2, essentially the same elements as in the exemplary embodiment of FIG. 1 are provided. In a departure from the latter, the modified portion of the armature 125 in the magnet core is embodied as a piston 136, which as a substitute for the diaphragm forms a movable wall, and the piston slides tightly in a bore 61 and thereby, with a housing cap 139, again tightly encloses a control chamber 141. The piston 136 thus separates this control chamber 141 from a pressure chamber 144, which is embodied identically to the pressure chamber 44 of the exemplary embodiment of FIG. 1. The bore 61 is provided in a housing part that comprises nonmagnetizable material, preferably in the form of a brass sleeve 65 that is firmly inserted into the housing, so that the piston is easily movable within this region, unaffected by the magnet. In its closing position shown in FIG. 2, the face end 66 of the piston reaches a seal 67, which is inserted on the cap 139, for example, in such a way that for guiding the piston the control chamber 141 is sealed off, if the exhaust gas recirculation valve is in its closing position. This averts the possibility that exhaust gas could enter the pressure chamber 144 via the guide, which because of the necessary displacement play of the piston would be possible and then could result in deposits of exhaust gas in the guide that then, particularly if the exhaust gas valve remains closed for relatively long periods, could cause increased friction and functional failures of the exhaust gas recirculation valve. The piston 136 may also, as shown, be provided with an axial recess 68, into which the conduit 42 discharges and which is filled with a soot filter. This provision likewise prevents soiling of the guidance of the piston 136 in the sleeve 65. Compared with the exemplary embodiment of FIG. 1, this embodiment has the substantial advantage that there is no need to make provisions for the eventuality of damage, such as breakage of the diaphragm in FIG. 1. Hence the valve has a substantially longer expected life. As in the preceding exemplary embodiment, a shielding cap 51 is also provided on the valve member 15 and prevents a dynamic exhaust gas pressure from reaching the control chamber 141.

The foregoing relates to preferred exemplary embodiments of the invention, it being understood that other variants and embodiments thereof are possible within the spirit and scope of the invention, the latter being defined by the appended claims.

The invention claimed and desired to be secured by Letters Patent of the United States is:

1. An exhaust gas recirculation valve for controlling quantities of recirculated exhaust gas that are delivered to an intake side of an internal combustion engine comprising an exhaust gas recirculation line (8) which has a conical valve seat (13), facing counter to the flow of exhaust gas in the exhaust gas recirculation line, a valve member (15) cooperates with said valve seat, said valve member is actuated by an armature (25, 125) of an electromagnet (20) that is disposed in a housing (24), said housing (24) communicates with a tube (1) carrying the recirculated exhaust gas onward, said valve member opens into the exhaust gas recirculation line (8) upstream of the valve seat and is disposed at an end of a valve shaft (17) that extends through a wall (2) of the tube (1) and is urged by a spring (29) in the closing direction of the valve member (15), the armature (25, 125) is firmly connected to the valve shaft (17), and the valve shaft (17) is connected at least indirectly firmly to a movable wall (36, 136) which on one side defines a pressure chamber (44, 144) that communicates with the interior of the tube (1) and tightly separates the pressure chamber from a control chamber (41, 141) adjoining the pressure chamber on another side and communicates with the exhaust gas recirculation line upstream of the valve seat (13).

2. An exhaust gas recirculation valve in accordance with claim 1, in which the control chamber (41, 141) communicates with the exhaust gas recirculation line (6, 8) upstream of the valve seat via a conduit (42) in the valve shaft (17).

3. An exhaust gas recirculation valve in accordance with claim 2, in which a surface area of the valve member (15) acted upon in the closing direction by the exhaust gas pressure is substantially equal in size to the surface area of a movable wall (36, 136) that defines the control chamber (41, 141) and acts upon the valve shaft (17) in the opening direction of the valve member (15).

4. An exhaust gas recirculation valve in accordance with claim 2, in which a shielding cap (51) is provided on the valve member (15) and has a wall (52) placed ahead of a mouth (50) of the conduit (42), facing counter to the flow direction of the oncoming exhaust gas.

5. An exhaust gas recirculation valve in accordance with claim 2, in which the exhaust gas recirculation line is embodied in the form of a connection neck (8), on which the valve seat (13) is embodied and which vertically into the tube (1).

6. An exhaust gas recirculation valve in accordance with claim 2, in which the electromagnet (20) is triggered by a control unit in clocked fashion with a variable duty cycle, in order to position the exhaust gas recirculation valve in various open positions.

7. An exhaust gas recirculation valve in accordance with claim 1, in which a surface area of the valve member (15) acted upon in the closing direction by the exhaust gas pressure is substantially equal in size to the surface area of a movable wall (36, 136) that defines the control chamber (41, 141) and acts upon the valve shaft (17) in the opening direction of the valve member (15).

8. An exhaust gas recirculation valve in accordance with claim 7, in which the movable wall is a diaphragm (36), whose edges on the one hand are fastened in the housing (24, 38, 39) and on the other hand are tightly joined to the valve shaft (17), allowing the passage therethrough of the conduit.

9. An exhaust gas recirculation valve in accordance with claim 7, in which the movable wall (136) is embodied as a piston guided tightly in the housing.

10. An exhaust gas recirculation valve in accordance with claim 9, in which the piston (136) is part of the armature (125) and as an extension thereof slides in a nonmagnetizable part (65).

11. An exhaust gas recirculation valve in accordance with claim 10, in which the armature in its terminal position, corresponding to the closing position of the valve member, is in tight contact with a seal (67) that in this position of the armature (136) separates the control chamber (141) from the guidance of the armature in the nonmagnetizable part (65).

12. An exhaust gas recirculation valve in accordance with claim 7, in which the valve seat (13) and the sealing face (16) of the valve member (15) are embodied conically.

13. An exhaust gas recirculation valve in accordance with claim 1, in which the armature is embodied as a solenoid plunger (25, 125), which is secured to the valve shaft (17).

14. An exhaust gas recirculation valve in accordance with claim 13, in which the electromagnet (20) is embodied as a linear magnet.

15. An exhaust gas recirculation valve in accordance with claim 13, in which the armature (25, 125) and the magnet core (19) of the electromagnet (20) have conduits (46, 47) which establish the communication between the tube (1) and the pressure chamber (44, 144).

16. An exhaust gas recirculation valve in accordance with claim 1, in which a shielding cap (51) is provided on the valve member (15) and has a wall (52) placed ahead of a mouth (50) of the conduit (42), facing counter to the flow direction of the oncoming exhaust gas.

17. An exhaust gas recirculation valve in accordance with claim 1, in which the exhaust gas recirculation line is embodied in the form of a connection neck (8), on which the valve seat (13) is embodied and which vertically into the tube (1).

18. An exhaust gas recirculation valve in accordance with claim 17, in which the connection neck (8) is formed of drawn sheet metal and adjoining the valve seat changes into a tubular part (14) that surrounds the valve shaft (17) and extends approximately to a middle of the tube (1).

19. An exhaust gas recirculation valve in accordance with claim 18, in which the tubular part (14) is located immediately upstream of a throttle valve (49) that controls the flow cross section of the tube (1).

20. An exhaust gas recirculation valve in accordance with claim 1, in which the electromagnet (20) is triggered by a control unit in clocked fashion with a variable duty cycle, in order to position the exhaust gas recirculation valve in various open positions.

* * * * *